US006766758B1

(12) United States Patent
Zoss et al.

(10) Patent No.: US 6,766,758 B1
(45) Date of Patent: Jul. 27, 2004

(54) FOLDING BOAT

(76) Inventors: Michael Zoss, 361 Del Norte St., Denver, CO (US) 80221; Travis Moring, 361 Del Norte St., Denver, CO (US) 80221

( * ) Notice: Subject to any disclaimer, the term of this patent is extended or adjusted under 35 U.S.C. 154(b) by 0 days.

(21) Appl. No.: 10/692,599

(22) Filed: Oct. 24, 2003

(51) Int. Cl.[7] ..... B63B 7/00
(52) U.S. Cl. ..... 114/353
(58) Field of Search ..... 114/352, 353, 114/354

(56) References Cited

U.S. PATENT DOCUMENTS 3,056,147 A * 10/1962 Straussler ..... 114/354
3,097,371 A * 7/1963 Rough ..... 114/344
3,257,987 A * 6/1966 Liard ..... 440/31
3,594,834 A * 7/1971 Steensen ..... 114/353
4,829,926 A * 5/1989 Voelkel ..... 114/61.22
D314,741 S * 2/1991 Loper ..... D12/300
5,237,954 A * 8/1993 Evans ..... 114/352
5,803,007 A * 9/1998 Stevens ..... 114/266
6,067,925 A * 5/2000 Little ..... 114/354
6,164,238 A * 12/2000 Stokes ..... 114/353
6,647,913 B2 * 11/2003 Brignolio ..... 114/344

* cited by examiner

*Primary Examiner*—Andrew Wright

(57) ABSTRACT

A folding boat is disclosed comprising a deck, a plurality of safety fences and a plurality of pontoons. The deck floor is composed of a plurality of various deck sections that are pivotally hinged to each other so that they form a common coplanar deck flooring for use in the operational mode of the folding boat. The plurality of various deck sections can be easily folded into a substantially compact configuration so that the folded boat can be conveniently stored and easily transported. Floatation of the folding boat is provided by a plurality of pontoons attached to some of the deck panels that make up the common coplanar floor. The folding boat further comprises a safety fence composed along the starboard and port sides.

19 Claims, 2 Drawing Sheets

FOLDING BOAT

BACKGROUND OF THE INVENTION

1. Field of Invention

This invention relates to folding boats and more particular to folding boats that are easily portable, lightweight and convenient to store in a folded configuration.

2. Description of Related Information

Folding boats are a desirable item for sports enthusiasts who do not have the space to store full size boats, or the capacity to transport a full size boat to and from waterways. In addition, folding boats are desirable for use a secondary water craft in instances of where a larger recreational boat does not have sufficient storage space for dinghies. Existing portable folding boats are either expensive to manufacture, difficult to assemble, prone to leakage or are not sufficiently compact enough in their folded configurations to be easily transportable by the average sized automobile. Furthermore, there are no folding boats that have safety rails that can be erected when the boat is in the operational mode. While the following examples of prior art all deal with these problems to some degree, they all tend to be either to impractical, complicated and time consuming to assemble an duse, or not versatile or efficient for many separate uses or conditions.

The folding boat disclosed by Straussler in U.S. Pat. No. 3,056,147 may be relatively easy to boat to unfold into an operational mode, however, the two large seams along the two hull are prone to leaking. Furthermore, this boat folds lengthwise and thus making storage and transportation of this design cumbersome. In addition, this design lacks any type of safety rail.

The lightweight folding boat with tent and trailer as disclosed by Stokes in U.S. Pat. No. 6,164,238 is relatively easy to unfold and is not prone to leaking. However, this folding boat design inherently requires trailer for transporting the boat. Also, the folded configuration is bulky and thus difficult to store conveniently. In addition, this design lacks any type of safety rail.

The folding boat as disclosed by Rough in U.S. Pat. No. 3,097,371 is also relatively easy to unfold and not likely to leak. However, this design suffers the same disadvantages as stated above because the folded boat is bulky which likely would require a trailer as well as certainly require a relatively expansive area to store. In addition, this design lacks any type of safety rail.

The portable, foldable and collapsible water cycle disclosed by Liard in U.S. Pat. No. 3,257,987 may unfold easily however because of folding the boat along the entire longitudinal axis results in difficulties in transporting and storing this design. In addition, this design lacks any type of safety rail.

The folding boat disclosed by Steensen in U.S. Pat. No. 3,594,834 may also unfold easily however the boat in the folded configuration remains bulky and thus would likely require a trailer to transport the device and also would require a considerable storage area. Furthermore, this design lacks any type of safety rail.

The folding boat disclosed by Loper in U.S. Pat. No. D314,741 unfolds easily, however the boat in the folded configuration remains bulky and thus would likely require a trailer to transport the device and also would require a considerable storage area. Furthermore, this design lacks any type of safety rail.

None of the above mentioned disclosures have adequately addressed the problem of designing a foldable boat that is relatively inexpensive, easy to unfold, convenient to transport while minimizing the necessary storage space, as well as, providing a safety rail on the foldable boat. Therefore, there is a need for such an apparatus. The instant invention is designed to overcome these problems by providing an affordable folding boat that is easy to transport on or in a standard-sized commercial vehicle, easy to unfold into an operational mode, storable in a minimum storage area, that also provides a safety rail.

SUMMARY OF THE INVENTION

The apparatus of the present invention overcome the above-mentioned disadvantages and drawbacks that are characteristic of these aforementioned designs. More particularly, a preferred embodiment of the present invention comprises a foldable boat apparatus that is easy to transport, easy to unfold into an operational mode, storable in a minimal area and having a safety rail.

In a preferred embodiment, the folding boat comprises a first and second main panels, wherein each of the first and second main panels having a top, a bottom, a forward end, a rearward end, and two opposing sides, wherein the first main panel rearward end is pivotally hinged to the second main panel forward end, wherein the second main panel is movable and lockable to an operational position where the second main panel is substantially coplanar with the first main panel, and wherein the second main panel is movable and lockable to a folded position where the second main panel top substantially faces the first main panel top; a first, second, third, and fourth pontoons wherein each of the of the first, second, third, and fourth pontoons having a front end and a rear end, wherein the first and second pontoons are attached to to the first main panel bottom where the first and second pontoon are attached substantially in parallel with respect to each other and where the first and second pontoon front ends are substantially aligned towards the forward end of the first main panel and where the first and second pontoon rear ends are substantially aligned towards the first main panel rearward end, wherein the third and fourth pontoons are attached to the second main panel bottom where the third and fourth pontoon are attached substantially in parallel with respect to each other and where the third and fourth pontoon front ends are substantially aligned towards the forward end of the second main panel and where the third and fourth pontoon rear ends are substantially aligned towards the second main panel rearward end; a first, second, third, and fourth drop leaf panels, wherein the first and second drop leaf panels are pivotally hinged to separate sides of the opposite two sides of the first main panel, respectively, wherein the first and second drop leaf panels are movable and lockable to the operation position where the first and second drop leaf panels are substantially coplanar to the first main panel and wherein the first and second drop leaf panels are movable and lockable to the folded position where the first and second drop leaf panels are substantially perpendicular to the first main panel top, wherein the third and fourth drop leaf panels are pivotally hinged to separate sides of the opposite two sides of the second main panel, respectively, wherein the third and fourth drop leaf panels are movable and lockable to the operation position where the third and fourth drop leaf panels are substantially coplanar to the second main panel and wherein the third and fourth drop leaf panels are movable and lockable to the folded position where the third and fourth drop leaf panels are substantially perpendicular to the second main panel top; and a first, second, third and fourth fences wherein the first, second, third and fourth fences each having a base, a plurality of legs and a handrail, wherein each base is pivotally hinged to the bottom ends of the corresponding the plurality of legs and where the top ends of the corresponding the plurality of legs is pivotally hinged to the corresponding the handrail, wherein the handrails and the corresponding plurality of legs are movable and lockable to the operational position where the corresponding the plurality of legs are substantially perpendicular to the corresponding the bases, and wherein the handrails and the corresponding the plurality of legs are movable and lockable to the folded position where the corresponding the plurality of legs relative to the corresponding the base form an acute angle of less than twenty five degrees, wherein each base corresponding to each of the first, second, third, and fourth fences is individually pivotally hinged to a separate corresponding first, second, third, and fourth drop leaf panel, respectively, wherein each base is movable and lockable to the operational position where its corresponding the plurality of legs are substantially perpendicular to its' corresponding panel surface, and wherein each of base is movable and lockable to the folded position where its corresponding plurality of legs are substantially parallel to its' corresponding panel surface.

BRIEF DESCRIPTION OF THE DRAWINGS

For a more complete understanding of the present invention and for further objects and advantages thereof, reference may now be had to the following description taken in conjunction with the accompanying drawing in which.

DETAILED DISCLOSURE OF PREFERRED EMBODIMENTS

Figure 1:
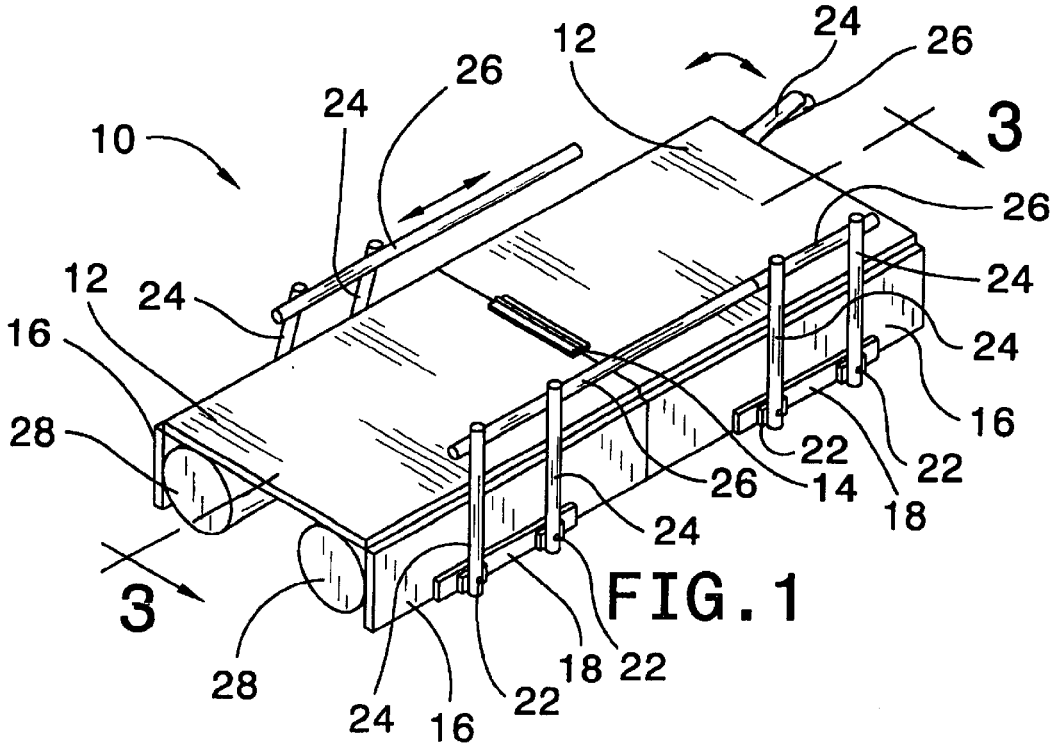
FIG. 1 is a perspective view of a partially unfolded folding boat device according to the present invention.

Although specific features of the invention are shown in some drawings and not others, this is for convenience only as each feature may be combined with any or all of the other features in accordance with the invention.

While preferred illustrative embodiments of the invention are described above, it will be apparent to those skilled in the art that various changes and modifications may be made without departing from the invention. The appended claims are intended to cover all changes within the spirit of the invention.

Referring now to the drawings, and particularly to FIGS. 1–4, a preferred embodiment of the folding boat device of the present invention is shown and generally designed by the reference numeral 10. This preferred embodiment of the folding boat 10 comprises two main panels 12 pivotally attached to each other by a hinge means 14. Along the flanks of the main panels 12 are pivotally attached a plurality of drop leaf panels 16 which when aligned in a coplanar orientation to the main panels 12 form an extended deck floor of the folding boat 10. Each drop leaf panel 16 is pivotally attached to a base 18 by a base-panel hinge means 20, wherein the base 18 is also pivotally attached by a base-leg hinge means 22 to the bottom ends of the corresponding plurality of legs 24. The top ends of the plurality of legs 24 are pivotally attached to a corresponding handrail 26 by a leg-handrail hinge means (not illustrated). The base 18, the corresponding plurality of legs 24, and the corresponding handrail 26 comprise the safety fence associated with each drop leaf panel 16. Also shown is a plurality of pontoons 28 attached to the bottom of each of the main deck panels 12.

Referring now to FIG. 1, which is a perspective view of a preferred embodiment of the folding boat 10 depicted in a partially unfolded mode where the hinge means 14 allows the alignment of the main panels 12 to be moved to the operative position by assuring the main panels 12 are substantially coplanar to one another. The drop leaf panels 16 are shown in the folded position where the drop leaf panels 16 are substantially perpendicular to the main panels 12. The safety fence is shown in a partial unfolded mode where the plurality of the legs 24 are movable via the base-panel hinge means 20 to an orientation that is substantially in parallel to the surface of the drop leaf panels 16. Also shown is the plurality of pontoons 28 attached to the bottom of the main panels 12.

Figure 2:
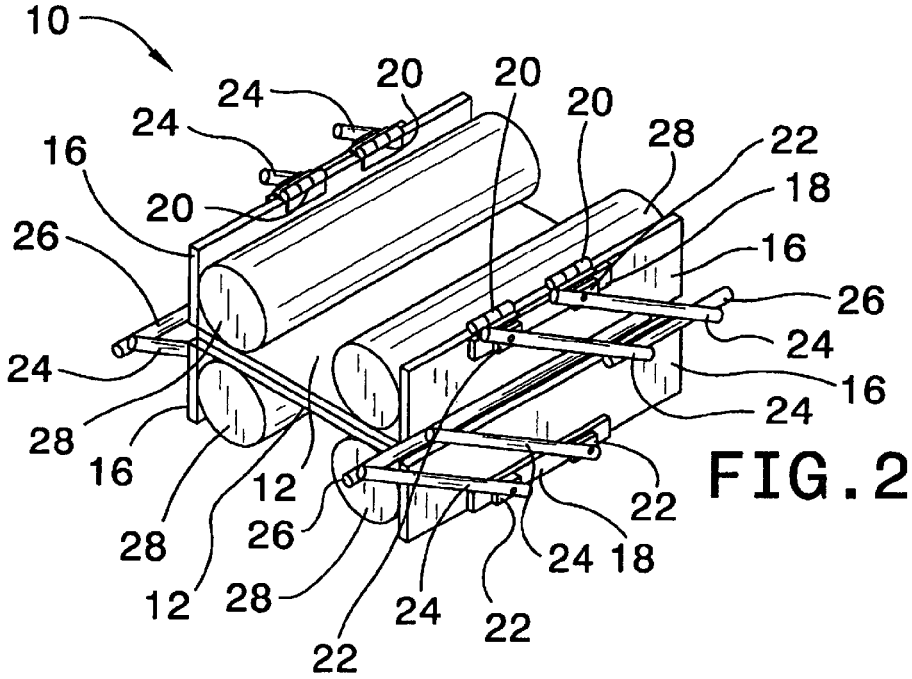
FIG. 2 is a perspective view of a fully folded folding boat device according to the present invention.

Referring now to FIG. 2, which is a perspective view of a preferred embodiment of the folding boat 10 in its' fully folded position where the top surfaces of the main decks 12 are aligned where the tops of the main decks 12 are substantially facing one another. The drop leaf panels 16 are aligned so that the drop leaf panels 16 are substantially perpendicular to the main deck panels 12. The plurality of legs 24 are aligned substantially in parallel to the corresponding drop leaf panel 16 by the base-panel hinge means 20. The plurality of legs 24 relative the corresponding base 18 are aligned by the base-leg hinge means 22 and by the leg-handrail hinge means (not illustrated) wherein the angle of the plurality of legs 24 forms an acute angle relative to their bases 18 of less than twenty five degrees in the stored position. The bases 18 are pivotally attached to each of their respective drop leaf panels 16 by a base-panel hinge means 20. The plurality of support arms are pivotally attached to a plurality of corresponding handrails 26 by an leg-handrail hinge means (not illustrated). The plurality of pontoons 28 is shown in contact with the bottom of the main deck panels 12. Also shown is the plurality of pontoons 28 attached to the bottom of the main panels 12.

Figure 3:
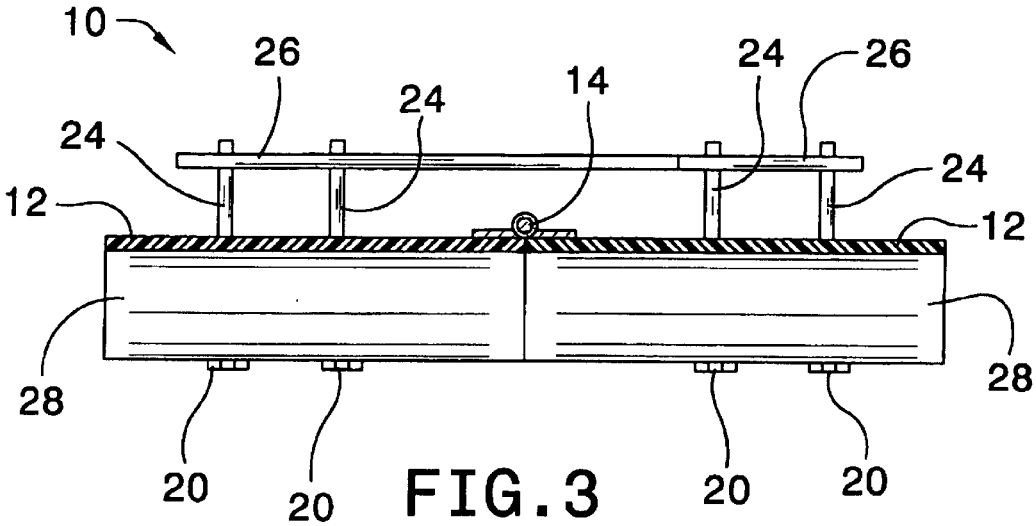
FIG. 3 is a cut away view of a partially unfolded folding boat device according to the present invention.

Referring now to FIG. 3, which is a cut away section showing a partially unfolded folding boat 10 configuration. The main deck panels 12 are pivotally attached to each other by a hinge means 14 in which the main deck panels 12 are shown aligned in the operational position by being aligned in a coplanar configuration to one another. The base-panel hinge means 20 that attaches the drop leaf panels 16 (not shown) to the base 12 (not shown) is depicted at the bottom of this figure in a folded position. The plurality of legs 24 are pivotally attached to their corresponding handrails 26 by the leg-handrail hinge means (not illustrated) aligned in a partial unfolded position where the plurality of legs 24 are substantially in parallel to their corresponding drop leaf panels 16 (not shown in FIG. 3). The plurality of legs 24 are also show in a partial operational position where the plurality of legs 24 are substantially perpendicular to their corresponding handrails 26. The plurality of pontoons 28 is attached to the bottom of the main deck panels 12.

Figure 4:
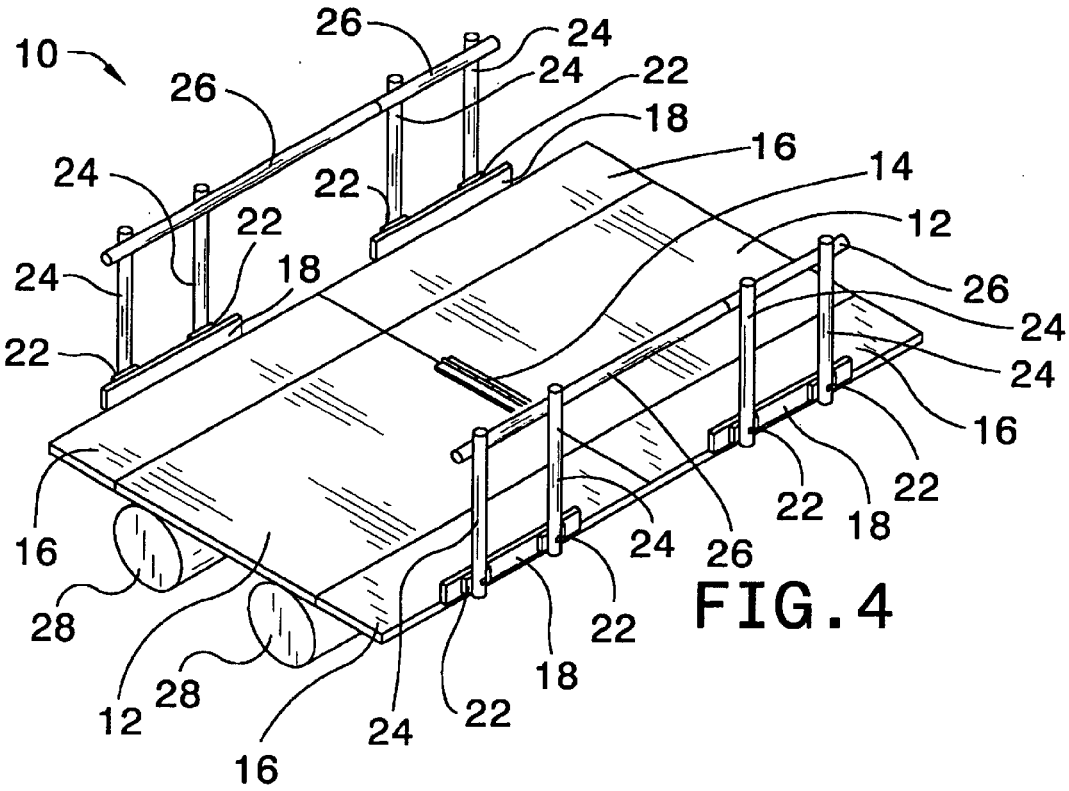
FIG. 4 is a perspective view of a fully unfolded folding boat device in its' operational position according to the present invention.

Referring now to FIG. 4, which is a perspective view of a preferred embodiment of the folding boat 10 in the fully operational position where the main deck panels 12 are pivotally attached to each other by the hinge means 14 that allows alignment of the two main deck panels 12 to be substantially coplanar. The plurality of pontoons 28 are shown attached to the bottom of the main deck panels 12. The main deck panels 12 are pivotally attached to their corresponding drop leaf panels 16 along the two sides of the main deck panels 12 by the deck-panel hinge means (not illustrated) which allows the drop leaf panel 16 to be aligned substantially coplanar to their corresponding attached main deck panels 12. Each drop leaf panel 16 is also pivotally attached to a base 18 via a base-panel hinge means 20 (not shown). Each base 18 is pivotally attached to the ends of their corresponding plurality of legs 24 via a base-leg hinge means 20. The tops of the plurality of legs 24 are pivotally attached to the corresponding handrails 26 via a leg-handrail hinge means (not illustrated). Wherein the base-leg hinge means 22 and the leg-handrail hinge means (not illustrated) allow alignment of said plurality of legs 24 to be substantially perpendicular to their corresponding bases 18 as well as substantially perpendicular to their corresponding handrails 26 in the folding boat 10 operational position.

It is thus believed that the operation and construction of the present invention will be apparent from the foregoing description. While the apparatus shown or described has been characterized as being preferred it will be obvious that various changes and modifications may be made therein without departing from the spirit and scope of the invention as defined in the following claims.

We claim:

1. A folding boat comprising:

a first and second main panels, wherein each of said first and second main panels having a top, a bottom, a forward end, a rearward end, and two opposing sides, wherein said first main panel rearward end is pivotally hinged to said second main panel forward end, wherein said second main panel is movable to an operational position where said second main panel is substantially coplanar with said first main panel, and wherein said second main panel is movable to a folded position where said second main panel top substantially faces said first main panel top;

a first, second, third, and fourth pontoons wherein each of said of said first, second, third, and fourth pontoons having a front end and a rear end, wherein said first and second pontoons are attached to said first main panel bottom where said first and second pontoon are attached substantially in parallel with respect to each other and where said first and second pontoon front ends are substantially aligned towards said forward end of said first main panel and where said first and second pontoon rear ends are substantially aligned towards said first main panel rearward end, wherein said third and fourth pontoons are attached to said second main panel bottom where said third and fourth pontoon are attached substantially in parallel with respect to each other and where said third and fourth pontoon front ends are substantially aligned towards said forward end of said second main panel and where said third and fourth pontoon rear ends are substantially aligned towards said second main panel rearward end;

a first, second, third, and fourth drop leaf panels, wherein said first and second drop leaf panels are pivotally hinged to separate sides of said two opposing sides of said first main panel, respectively, wherein said first and second drop leaf panels are movable to said operational position where said first and second drop leaf panels are substantially coplanar to said first main panel and wherein said first and second drop leaf panels are movable to said folded position where said first and second drop leaf panels are substantially perpendicular to said first main panel top, wherein said third and fourth drop leaf panels are pivotally hinged to separate sides of said opposing two sides of said second main panel, respectively, wherein said third and fourth drop leaf panels are movable to said operational position where said third and fourth drop leaf panels are substantially coplanar to said second main panel and wherein said third and fourth drop leaf panels are movable to said folded position where said third and fourth drop leaf panels are substantially perpendicular to said second main panel top; and a first, second, third and fourth fences wherein said first, second, third and fourth fences each having a base, a plurality of legs and a handrail, wherein each base is pivotally hinged to the bottom ends of the corresponding said plurality of legs and where the top ends of the corresponding said plurality of legs is pivotally hinged to the corresponding said handrail, wherein said handrails and the corresponding plurality of legs are movable to said operational position where the corresponding said plurality of legs are substantially perpendicular to the corresponding said bases, and wherein said handrails and the corresponding said plurality of legs are movable to said folded position where the corresponding said plurality of legs relative to the corresponding said base form an acute angle of less than twenty five degrees, wherein each base corresponding to each of said first, second, third, and fourth fences is individually pivotally hinged to a separate corresponding first, second, third, and fourth drop leaf panel, respectively, wherein each base is movable to said operational position where its' corresponding said plurality of legs are substantially perpendicular to its' corresponding panel surface, and wherein each of base is movable to said folded position where its' corresponding plurality of legs are substantially parallel to its' corresponding panel surface.

2. The folding boat as described in claim 1, wherein said pontoons are rigid.

3. The folding boat as described in claim 1, wherein said pontoons are non-rigid.

4. The folding boat as described in claim 3, wherein said pontoons are inflatable.

5. The folding boat as described in claim 1 wherein said pontoons are detachable.

6. The folding boat as described in claim 5, wherein the dimensions of said folding boat where configured in said folded position are approximately 6 feet long, approximately 3 feet wide and approximatelly 3½ to 5 inches tall when said pontoons are detached.

7. The folding boat as described in claim 1 wherein the dimensions of said folding boat where extended to said operational position are approximately 12 feet long, approximately 6 feet wide long and approximately 2 to 4½ feet tall.

8. The folding boat as described in claim 1 wherein the total weight of said folding boat is less than 100 pounds.

9. The folding boat as described in claim 1 wherein said folding boat is a canoe.

10. The folding boat as described in claim 1 wherein said first and second main deck panels are substantially identical to each other.

11. The folding boat as described in 10 wherein said first, second, third, and fourth drop leaf panels are substantially identical to each other.

12. The folding boat as described in claim 1 wherein said first, second, third, and fourth drop leaf panels are substantially identical to each other.

13. A folding boat comprising:

a first and second main panels, wherein each of said first and second main panels having a top, a bottom, a forward end, a rearward end, and two opposing sides, wherein said first main panel rearward end is pivotally hinged to said second main panel forward end, wherein said second main panel is movable and lockable to an operational position where said second main panel is substantially coplanar with said first main panel, and wherein said second main panel is movable to a folded position where said second main panel top substantially faces said first main panel top;

a first, second, third, and fourth pontoons wherein each of said of said first, second, third, and fourth pontoons having a front end and a rear end, wherein said first and second pontoons are attached to said first main panel bottom where said first and second pontoon are attached substantially in parallel with respect to each other and where said first and second pontoon front ends are substantially aligned towards said forward end of said first main panel and where said first and second pontoon rear ends are substantially aligned towards said first main panel rearward end, wherein said third and fourth pontoons are attached to said second main panel bottom where said third and fourth pontoon are attached substantially in parallel with respect to each other and where said third and fourth pontoon front ends are substantially aligned towards said forward end of said second main panel and where said third and fourth pontoon rear ends are substantially aligned towards said second main panel rearward end;

a first, second, third, and fourth drop leaf panels, wherein said first and second drop leaf panels are pivotally hinged to separate sides of said two opposing sides of said first main panel, respectively, wherein said first and second drop leaf panels are movable and lockable to said operational position where said first and second drop leaf panels are substantially coplanar to said first main panel and wherein said first and second drop leaf panels are movable to said folded position where said first and second drop leaf panels are substantially perpendicular to said first main panel top, wherein said third and fourth drop leaf panels are pivotally hinged to separate sides of said two opposing sides of said second main panel, respectively, wherein said third and fourth drop leaf panels are movable and lockable to said operational position where said third and fourth drop leaf panels are substantially coplanar to said second main panel and wherein said third and fourth drop leaf panels are movable to said folded position where said third and fourth drop leaf panels are substantially perpendicular to said second main panel top; and a first, second, third and fourth fences wherein said first, second, third and fourth fences each having a base, a plurality of legs and a handrail, wherein each base is pivotally hinged to the bottom ends of the corresponding said plurality of legs and where the top ends of the corresponding said plurality of legs is pivotally hinged to the corresponding said handrail, wherein said handrails and the corresponding plurality of legs are movable and lockable to said operational position where the corresponding said plurality of legs are substantially perpendicular to the corresponding said bases, and wherein said handrails and the corresponding said plurality of legs are movable to said folded position where the corresponding said plurality of legs relative to the corresponding said base form an acute angle of less than twenty five degrees, wherein each base corresponding to each of said first, second, third, and fourth fences is individually pivotally hinged to a separate corresponding first, second, third, and fourth drop leaf panel, respectively, wherein each base is movable and lockable to said operational position where its' corresponding said plurality of legs are substantially perpendicular to its' corresponding panel surface, and wherein each of base is movable to said folded position where its' corresponding plurality of legs are substantially parallel to its' corresponding panel surface.

14. The folding boat as described in claim 13, wherein said pontoons are non-rigid.

15. The folding boat as described in claim 13, wherein said folding boat is a canoe.

16. The folding boat as described in claim 13, wherein said first and second main deck panels are substantially identical to each other.

17. A folding boat comprising:

a first and second main panels, wherein each of said first and second main panels having a top, a bottom, a forward end, a rearward end, and two opposing sides, wherein said first main panel rearward end is pivotally hinged to said second main panel forward end, wherein said second main panel is movable and lockable to an operational position where said second main panel is substantially coplanar with said first main panel, and wherein said second main panel is movable and lockable to a folded position where said second main panel top substantially faces said first main panel top;

a first, second, third, and fourth pontoons wherein each of said of said first, second, third, and fourth pontoons having a front end and a rear end, wherein said first and second pontoons are attached to said first main panel bottom where said first and second pontoon are attached substantially in parallel with respect to each other and where said first and second pontoon front ends are substantially aligned towards said forward end of said first main panel and where said first and second pontoon rear ends are substantially aligned towards said first main panel rearward end, wherein said third and fourth pontoons are attached to said second main panel bottom where said third and fourth pontoon are attached substantially in parallel with respect to each other and where said third and fourth pontoon front ends are substantially aligned towards said forward end of said second main panel and where said third and fourth pontoon rear ends are substantially aligned towards said second main panel rearward end;

a first, second, third, and fourth drop leaf panels, wherein said first and second drop leaf panels are pivotally hinged to separate sides of said two opposing sides of said first main panel, respectively, wherein said first and second drop leaf panels are movable and lockable to said operational position where said first and second drop leaf panels are substantially coplanar to said first main panel and wherein said first and second drop leaf panels are movable and lockable to said folded position where said first and second drop leaf panels are substantially perpendicular to said first main panel top, wherein said third and fourth drop leaf panels are pivotally hinged to separate sides of said two opposing sides of said second main panel, respectively, wherein said third and fourth drop leaf panels are movable and lockable to said operational position where said third and fourth drop leaf panels are substantially coplanar to said second main panel and wherein said third and fourth drop leaf panels are movable and lockable to said folded position where said third and fourth drop leaf panels are substantially perpendicular to said second main panel top; and a first, second, third and fourth fences wherein said first, second, third and fourth fences each having a base, a plurality of legs and a handrail, wherein each base is pivotally hinged to the bottom ends of the corresponding said plurality of legs and where the top ends of the corresponding said plurality of legs is pivotally hinged to the corresponding said handrail, wherein said handrails and the corresponding plurality of legs are movable and lockable to said operational position where the corresponding said plurality of legs are substantially perpendicular to the corresponding said bases, and wherein said handrails and the corresponding said plurality of legs are movable and lockable to said folded position where the corresponding said plurality of legs relative to the corresponding said base form an acute angle of less than twenty five degrees, wherein each base corresponding to each of said first, second, third, and fourth fences is individually pivotally hinged to a separate corresponding first, second, third, and fourth drop leaf panel, respectively, wherein each base is movable and lockable to said operational position where its' corresponding said plurality of legs are substantially perpendicular to its' corresponding panel surface, and wherein each of base is movable and lockable to said folded position where its' corresponding plurality of legs are substantially parallel to its' corresponding panel surface.

18. The folding boat as described in claim 17, wherein said pontoons are inflatable.

19. The folding boat as described in claim 17, wherein said first, second, third, and fourth drop leaf panels are substantially identical to each other.

* * * * *